US005177716A

United States Patent [19]

Kuo

[11] Patent Number: 5,177,716

[45] Date of Patent: Jan. 5, 1993

[54] ALARM CLOCK WITH AN IMPROVED SWITCH BUTTON ASSEMBLY

[76] Inventor: Davis Kuo, No. 4, Shin-Ho Rd., Tainan City, Taiwan

[21] Appl. No.: 894,596

[22] Filed: Jun. 6, 1992

Related U.S. Application Data

[63] Continuation-in-part of Ser. No. 712,736, Jun. 10, 1991, abandoned.

[51] Int. Cl.[5] ..... G04B 23/00

[52] U.S. Cl. ..... 368/262; 368/263; 200/35 R

[58] Field of Search ..... 368/72-74, 368/250, 254, 262-263; 200/33 R, 35 R

[56] References Cited

U.S. PATENT DOCUMENTS 4,148,182 4/1979 Abe et al. ..... 368/262
4,213,291 7/1980 Wooding ..... 368/263
4,307,460 12/1981 Polonsky ..... 368/74
4,693,612 9/1987 Yoshizawa ..... 368/74
4,858,211 8/1989 Dlsousky ..... 368/262
5,077,707 12/1991 Kuo .

*Primary Examiner*—Vit W. Miska
*Attorney, Agent, or Firm*—Cushman, Darby & Cushman

[57] ABSTRACT

A switch button assembly includes a casing having a front, a rear wall and a side wall interconnecting the front and rear walls. The side wall has an opening through it. The rear wall has a protrusion extending perpendicularly into the casing adjacent to the opening of the side wall. A first plate has a central hole, an arched notch along the periphery and a plurality of claw-like member extending from the periphery of a bottom face. A second plate has a central shaft with a latch at its free end and latched into the claw-like members through the central hole of the first plate. The second plate further includes a projection that extends movably into the arched notch of the first plate. The second plate can rotate with respect to the first plate where the projection of the second plate engages with the protrusion of the rear wall.

3 Claims, 6 Drawing Sheets

ALARM CLOCK WITH AN IMPROVED SWITCH BUTTON ASSEMBLY

CROSS-REFERENCE OF RELATED APPLICATION

This invention is a continuation-in-part application of U.S. patent application No. 07/712736 which was filed on Jun. 10, 1991, is now abandoned.

BACKGROUND OF THE INVENTION

1. Field of the Invention

The invention relates to an alarm clock, more particularly to the construction of a switch button assembly for an alarm clock having a snooze feature.

2. Description of the Related Art

Alarm clocks are to provide an alarm signal at a predetermined time. An alarm button is actuated to disable the alarm signal. Most alarm clocks are provided with a snooze feature which permits the generation of a second alarm signal shortly after the first alarm signal has stopped.

FIG. 1 shows a partially exploded view of a switch button assembly for an alarm clock which incorporates a snooze feature. The switch button assembly includes a first plate (B) having an elongated groove (B1) at a top portion thereof, two vertical slots (B2,B5) and a projection (B3) and a second plate (C) slightly bigger than the first plate (B) and which has two projections (C1,C2) adapted to pass through the elongated groove (B1) and attached alongside the first plate (B) by means of rivets (C3). A casing (A) has a hook (A5) and two projections (A1,A2) respectively aligned with said vertical slots (B2,B5) in said first plate (B) and a leaf spring (A4) and a switch lever (not shown) connect to an alarm generating mechanism (not shown) of the clock. The first plate (B) is provided in the casing (A) and is riveted thereto while one end of the leaf spring (A4) abuts against the projection (B3) of the first plate (B) in an upward position, as shown in FIG. 2. The first plate (B) is pressed so as to actuate the switch lever of the alarm generating mechanism to stop an alarm signal of the alarm clock. However, this does not disable the snooze feature of the alarm clock. The leaf spring (A4) causes the first plate (B) to rise again once the pressure applied thereon is removed. When it is desired to disable the snooze feature, that is the first plate (B) is prevented from rising again, the first plate (B) is slid lefttwise after being pressed, so that the hook (A5) of the casing engages the first plate (B) unabling it to rise again, as shown in FIG. 3.

Connection between the first and second plates, and mounting of the leaf spring on the casing are done wholly by rivet soldering method. In the event that a part of the above assembly requires replacement, the whole assembly must be replaced since soldered rivets can not be easily disassembled.

The above described alarm clock is also unattractive since it has two clearances N1 and N2 at its front portion, as shown in FIG. 4.

SUMMARY

Therefore, the main object of the present invention is to provide a switch button assembly for an alarm clock which can be easily assembled and disassembled while preventing damage to the other parts of the alarm clock.

Another object of the present invention is to provide a switch button assembly which has improved appearance compared to the prior art.

Accordingly, a switch button assembly of the present invention is incorporated in an alarm clock including a casing having a front wall, a rear wall and a side wall interconnecting the front and rear walls and having an opening therethrough, an alarm generating mechanism mounted on the front wall inside the casing and a switch lever connected to the alarm generating mechanism which stops an alarm signal when being compressed. The rear wall further has a protrusion extending perpendicularly into the casing adjacent to said opening of said side wall. The switch button assembly includes a first circular plate which has an arched notch along the periphery of the plate, a central hole and a pressing stud extending from a bottom face thereof. A second circular plate has a central shaft slidably extended into the central hole of the first plate to engage therein. The second plate further has a projection extended into the arched notch of the first plate and being movable therein when the second plate is rotated relative to the first plate. The combined plates is pivotally mounted in the opening of the side wall. Under that condition, the pressing stud of the first plate is abutted against by the switch lever of the alarm generating mechanism of the clock. The switch button can actuate the switch lever when the projection of the second plate is moved to a position due to rotation of the second plate relative to the first plate where the projection of the second plate is not engaged with the protrusion of the rear wall.

BRIEF DESCRIPTION OF THE DRAWINGS

Other features and advantages of this invention will become more apparent in the following detailed description, including drawings, all of which show a non-limiting form of the invention, and of which.

DETAILED DESCRIPTION OF THE PREFERRED EMBODIMENT

Figure 1:
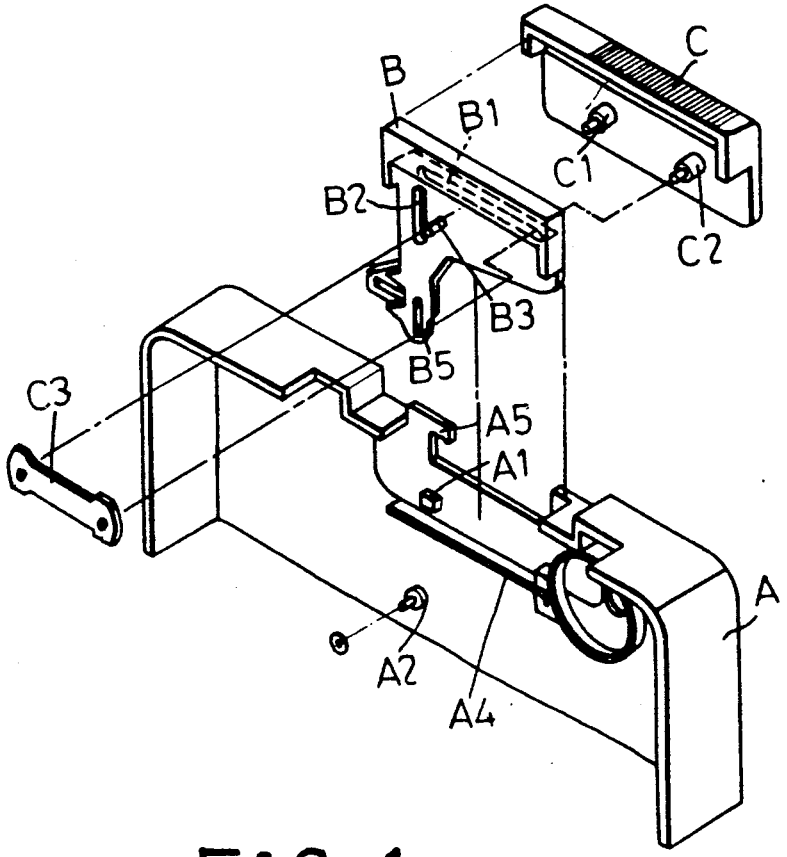
FIG. 1 (PRIOR ART)
FIG. 1 shows an exploded view of a switch button assembly of a conventional alarm clock.
Figure 2:
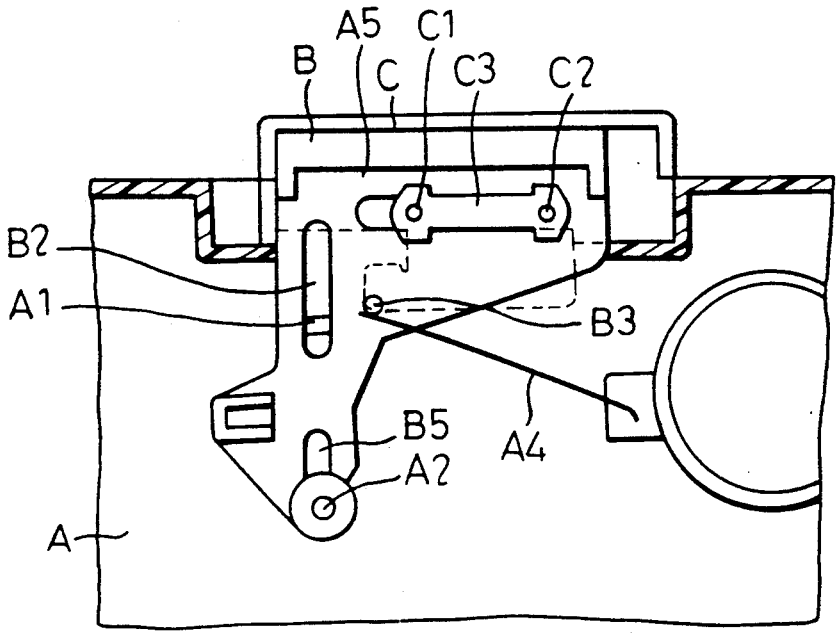
FIG. 2 (PRIOR ART)
FIG. 2 shows the switch button assembly of FIG. 1 in a raised position.
Figure 3:
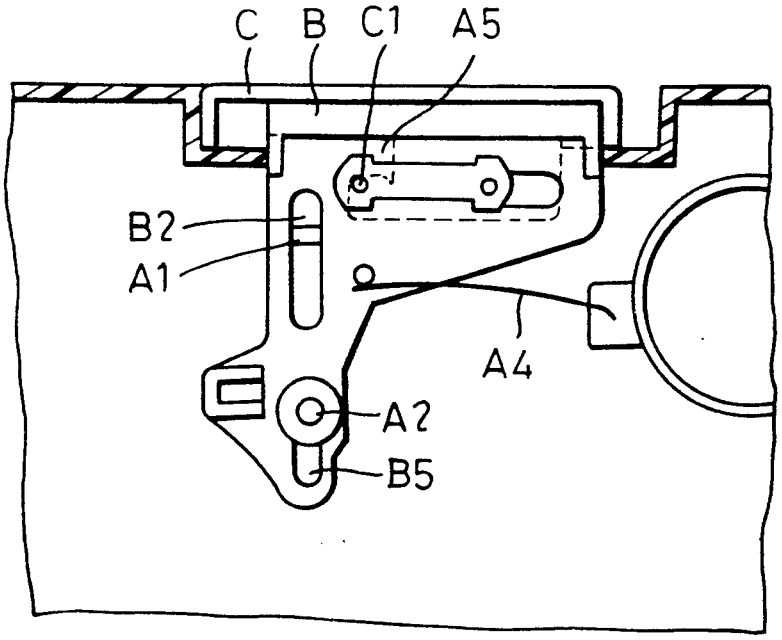
FIG. 3 (PRIOR ART)
FIG. 3 shows a switch button assembly of FIG. 1 in a locked position.
Figure 4:
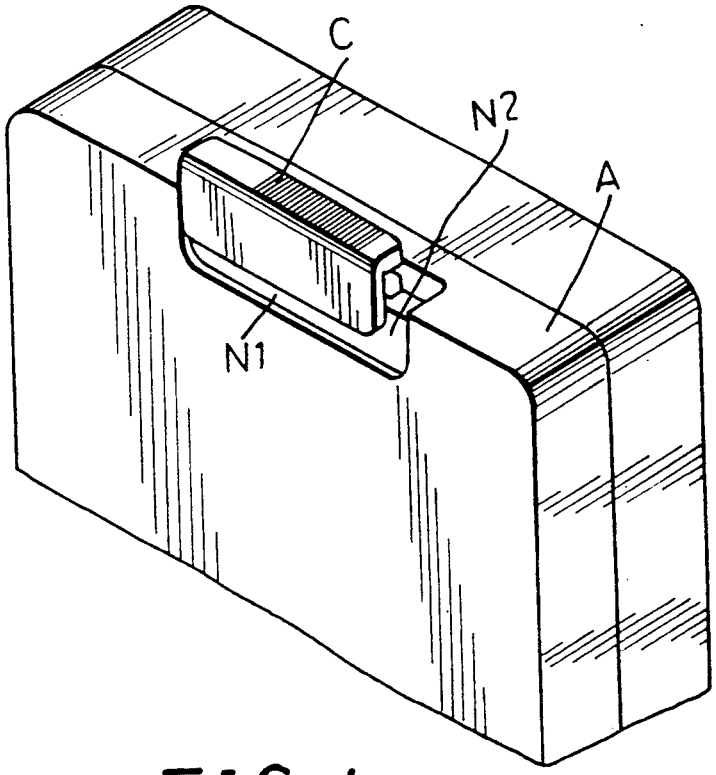
FIG. 4 (PRIOR ART)
FIG. 4 is a rear perspective view of the alarm clock of FIG. 1.
Figure 5:
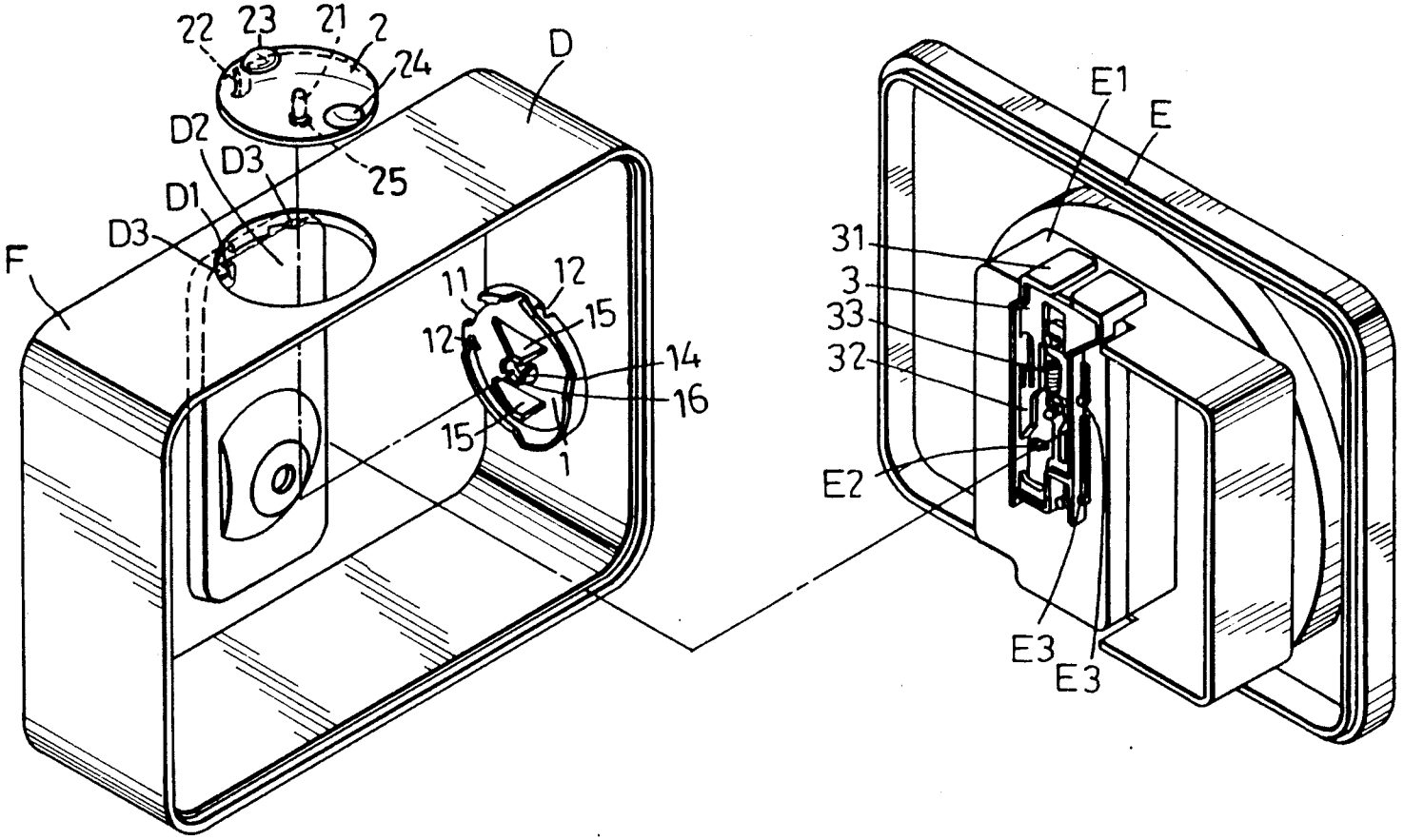
FIG. 5 is an exploded view of a switch button assembly of the present invention and its intended environment.
Figure 8:
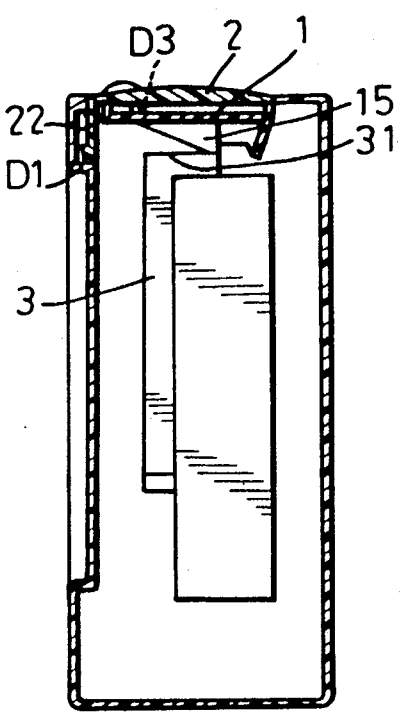
FIG. 8 is a cross section view of a switch button assembly of the present invention installed in an alarm clock and when in a pressed condition.

Referring to FIG. 5, a switch button assembly of the present invention is incorporated in an alarm clock with a snooze feature. The alarm clock includes a casing having a front wall (E), a rear wall (F) and a side wall (D) interconnecting the front wall (E) and the rear wall (F) and a switch lever (3) associated with the alarm generating mechanism (E1) of the clock. The alarm generating mechanism (E1) is mounted on the front wall (E) in a conventional manner.

The side wall (D) has an opening (D2) with two projections (D3) extending inwardly from the periphery of the opening (D2). The rear wall (F) has a protrusion (D1) extending perpendicularly into the casing adjacent to the opening (D2) of the side wall (D).

The switch button assembly includes a first circular plate (1) has a central through-hole (16) and an arched notch (11) along the periphery of the plate. A plurality of claw-like members (14) extend downward from the periphery of the central through-hole (16) of the first plate (1). A pair of wedge-like studs (15) similarly extend downward from the first plate (1). The first plate (1) further has two grooves (12) formed on an upper face thereof.

A second circular plate (2) is configured so as to correspond with the first plate (1) and has a central shaft (21) with a latch (25) at a free end and a projection (22) spaced from the shaft (21) and extending downwardly from the periphery of the plate (2). When the central shaft (21) is latched into the claw-like member (14) through the through-hole (16) of the first plate (1) so as to engage therein, the projection (22) of the second plate (2) extends into the arched notch (11) of the first plate (1). Under this condition, the latch (25) of the first plate (1) prevents the first plate (1) disengaging from the second plate (2). The projection (22) can move in the arched notch (11) when the second plate (2) rotates with respect to the first plate (1). In order to turn the second plate (2) with respect to the first plate (1) more easily, the second plate has a recessed portion (24) and protrusion portion (23) on an upper face thereof.

The switch lever (3) is mounted on the alarm generating mechanism (E1). The switch lever (3) can slide up and down on the alarm generating mechanism (E1). A torsional spring (33) has a first end connected to the alarm generating mechanism (E1) and a second end attached to the switch lever (3) in such a manner that the switch lever (3) is constantly urge upward. The switch lever (3) is provided with a tapered rod (32) which can push a tab (E2) to disconnect the alarm device of the alarm generating mechanism when the lever is compressed downward. The arrangement of setting the alarm device to give out a first alarm signal and a second alarm signal at a preset time is a known art and not directly concerned with the present invention. Therefore, detailed discussion of such are omitted here.

Figure 6:
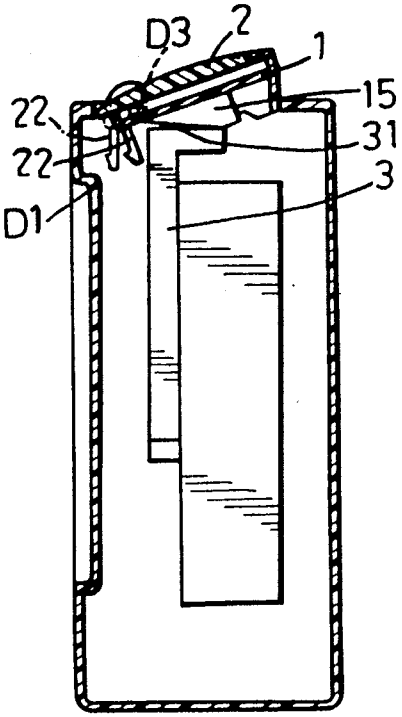
FIG. 6 is a cross section view of a switch button assembly of the present invention when installed in an alarm clock.
Figure 9:
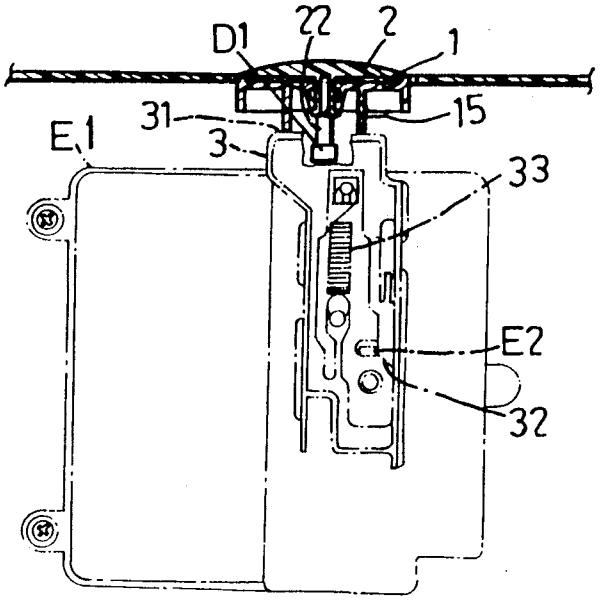
FIG. 9 is a side view of the switch button assembly of FIG. 8.
Figure 7:
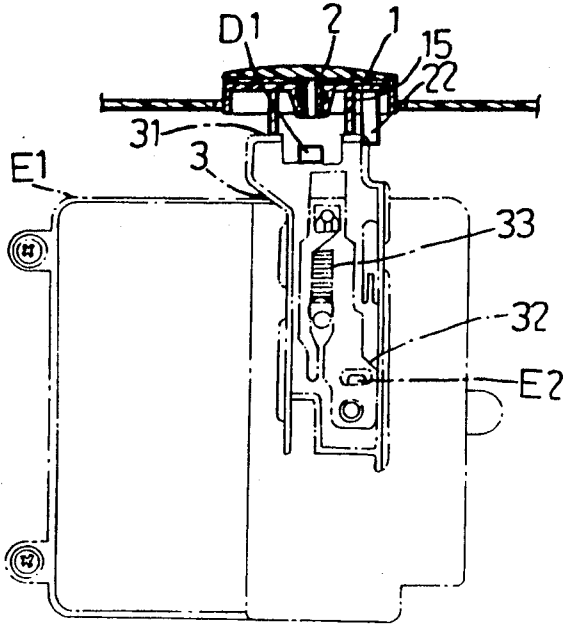
FIG. 7 is a side view of the switch button assembly of FIG. 6.

When the combined plates (1,2) is mounted in the opening (D2) of the side wall (D), the two projections (D3) extend into the groove (12) of the first plate (1). Under this condition, the first plate (1) can pivot about the two projections (D3) and since the top (31) of the frame (3) abuts against the pressing studs (15) of the first plate (1), the combined button assembly (1,2) will protrude from the casing through the opening (D2) of the side wall (D), as illustrated in FIG. 6. It is clear from the illustration that the projection (22) of the second plate (2) is spaced away from the protrusion (D1) of the rear wall (F). At this situation, the whole button assembly (1,2) can be pressed downward, thus stopping the alarm signal.

Once the imparted pressure is removed, the combined switch button assembly will return to its initial position as shown in FIG. 6. The alarm device of the alarm generating mechanism will give out a second alarm signal as previous arrangement.

Alternatively, we can rotate the second plate (2) relative to the first plate (1) so as to move the projection (22) of the second plate (2) in the arched notch at a position where the projection (22) engages with the protrusion (D1) of the rear wall (F) in which condition the combined button assembly (1,2) is stopped from being compressed, thus the alarm device will not be actuated.

It is clear from the above explanation, the switch button assembly of the present invention does not use rivet or other soldering method, but only simple ways of insertion one over the other. This is the most distinct feature of the present invention. In addition, the switch button assembly looks more attractive when compared to prior art models.

While a preferred embodiment has been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. An alarm clock, including a casing having a front wall, a rear wall and a side wall interconnecting said front and rear walls, an alarm generating mechanism mounted to said front wall inside said casing and operable so as to generate a first alarm signal at a predetermined time, said alarm generating mechanism including a spring-loaded and vertically actuated alarm switch lever which is pressed so as to stop the first alarm signal of said alarm generating mechanism, said alarm generating mechanism generating a second alarm signal a predetermined time period after the first alarm signal has stopped, and a switch button assembly mounted on said casing on a top portion of said side wall and being operated so as to apply pressure on said alarm switch lever, the improvement comprising:

said top portion of side wall having an opening formed therein and a pair of second projections extending radially inward into said opening;

said rear wall having a first projection extending perpendicularly therefrom into said casing adjacent to said opening;

said switch button assembly including: a first circular plate having a top face, a bottom face, a central hole formed therein and an arched groove formed along the periphery of said first circular plate, said first circular plate further having a plurality of claw-like members formed on said bottom face and extending from the periphery of said central hole, said first circular plate being pivotally mounted in said opening on said second projections of said side wall, said alarm switch lever abutting said first circular plate to urge said first circular plate to protrude through said opening; and a second circular plate having a central shaft with a latch slidably extending into said central hole of said first circular plate to engage said first and second circular plates, said second circular plate further having a third projection extending into said arched groove of said first circular plate and being movable in said arched groove of said first circular plate when said second circular plate is rotated relative to said first circular plate;

compression of said switch button assembly so as to actuate said alarm switch lever and disable the first alarm signal being permissible when said second circular plate is rotated relative to said first circular plate so as to move said third projection of said second circular plate in said arched groove to a first position away from said first projection of said rear wall; and said alarm switch lever being locked in a pressed position so as to prevent said alarm generating mechanism from generating the second alarm signal when said second circular plate is rotated relative to said first circular plate so as to move said third projection of said second circular plate to a second position in said arched groove of said first circular plate wherein said third projection engages said first projection of said rear wall.

2. The switch button assembly as claimed in claim 1, wherein said first plate has a pair of wedge-like studs extending from said bottom face thereof and abutting said alarm switch lever.

3. The switch button assembly as claimed in claim 1, wherein said top face of said first second plate is formed with a recessed portion and a protrusion portion spaced from said recessed portion.

* * * * *